US005905259A

United States Patent [19]

Franzen

[11] Patent Number: 5,905,259

[45] Date of Patent: May 18, 1999

[54] LINEAR TIME-OF-FLIGHT MASS SPECTROMETER WITH HIGH MASS RESOLUTION

[75] Inventor: Jochen Franzen, Bremen, Germany

[73] Assignee: Bruker Daltonik GmbH, Bremen, Germany

[21] Appl. No.: 08/919,295

[22] Filed: Aug. 28, 1997

[30] Foreign Application Priority Data

Sep. 3, 1996 [DE] Germany ..... 196 35 643

[51] Int. Cl.[6] ..... H01J 49/40

[52] U.S. Cl. ..... 250/287; 250/282

[58] Field of Search ..... 250/287, 282

[56] References Cited

U.S. PATENT DOCUMENTS 5,504,326 4/1996 Reilly et al. ..... 250/282
5,777,325 7/1998 Weinberger et al. ..... 250/287

FOREIGN PATENT DOCUMENTS 2305539 4/1997 United Kingdom .
2308492 6/1997 United Kingdom .
9636987 11/1996 WIPO .

OTHER PUBLICATIONS

Steven M. Colby et al, *Space–Velocity Correlation Focusing,* Analytical Chemistry, vol. 68, No. 8, Apr. 15, 1996.

Robert S. Brown et al., *Matrix Resolution Improvement by Incorporation of Pulsed Ion Extraction in a Matrix–Assisted Laser Desorption/Ionization Linear Time–of–Flight Mass Spectrometer,* Analytical Chemistry, vol. 67, No. 13, Jul. 1, 1995.

Eric D. Erickson et al., *Mass Dependence Of Time–Lag Focusing In Time–Of–Flight Mass Spectrometry–An Analysis,* International Journal of Mass Spectrometry and Ion Processes, vol. 97, pp. 87–106, 1990.

William B. Martin et al., *The Importance of the Time–Lag Parameter in a Laser/Time–Of–Mass Spectrometer*, International Journal of Mass Spectrometry and Ion Processes, vol. 77, pp. 203–221, 1987.

*Primary Examiner*—Jack I. Berman

[57] ABSTRACT

The invention relates to a linear time-of-flight mass spectrometer with ionization of analyte substances from surfaces and with improvement in mass resolution through delayed ion acceleration. It especially relates to the design of such a mass spectrometer and to a mass spectrometric measuring procedure for very high mass resolution in the spectrum.

The invention focuses the flight time of the ions in second order by dynamic alteration of at least one of the accelerating voltages applied to the ion source after the start of the delayed acceleration of the ions. In a most simple method, an easily generated exponential decay of the accelerating field in front of the sample support can be used. In computer simulations, resolutions of much greater than one million have been obtained.

16 Claims, 3 Drawing Sheets

LINEAR TIME-OF-FLIGHT MASS SPECTROMETER WITH HIGH MASS RESOLUTION

FIELD OF INVENTION

The invention relates to linear time-of-flight mass spectrometry with ionization of analyte substances from the surface of a sample support plate. It especially relates to a mass spectrometric measuring procedure for very high mass resolution in the spectrum, and to the design of a mass spectrometer to perform this method.

PRIOR ART

Among the methods for the ionization of macromolecular substances on sample supports, matrix assisted desorption by a laser light flash (MALDI=matrix assisted laser desorption and ionization) has found the widest acceptance. After leaving the surface, the ions generally have a substantial average velocity, which is to a large extent the same for ions of all masses, and a large spread around the average velocity. The average velocity leads to a non-linear relationship between the flight time and the root of the mass, i.e. the mass scale. The spread leads to a poor mass resolution when measuring the signals of the individual ion masses; however there is a method for improve mass resolution by focusing these ions in first order.

Similar conditions also apply for other methods of ionization of substances which are applied to a surface. Examples of this are secondary ion mass spectrometry (SIMS), normal laser desorption (LD) or so-called plasma desorption (PD), which is obtained by high-energy fission products on thin films. The common feature of all these ionizing methods consists in the presence of a pulsed ionizing beam. The pulsed beam may consist of a bunch of particles, a single high-energy particle, or a laser light flash.

In the following, the focus is on the MALDI method, however the invention is not limited solely to this method, but relates to all methods by which ions are generated which have a spread of initial velocities even if it is generally not as large as for the MALDI process.

For ionization by matrix-assisted laser desorption (MALDI), the large sample molecules are stored on a sample support in or on a crystalline layer of low-molecular matrix substance. A laser light pulse of a few nanoseconds duration focused onto the sample surface, vaporizes a small amount of the matrix substance in a quasi-explosive process, whereby the sample molecules are also transferred into the initially tiny vapor cloud.

The vapor cloud expanding into the vacuum not only accelerates the molecules and ions of the matrix substance through its adiabatic expansion, but also the molecules and ions of the sample substance through viscous entrainment, which thereby receive higher kinetic energies than would correspond to thermal equilibrium. Even without an accelerating field, the ions attain average velocities of about 500 to 1,000 meters per second, dependent upon the energy density of the laser beam; the velocities are to a large extent independent of the mass of the ions, however they have a large spread cf velocity which ranges from about 200 up to 2,000 meters per second.

The ions accelerated in the ion source with electrical fields at energies of around 5 to 30 keV are shot into the flight path of the mass spectrometer and detected with high time resolution at the end of the flight path. From their flight time, their mass-to-charge ratio can be determined. Since this type of ionization practically supplies only singly charged ions, we will use the term "mass determination" instead of the more correct term "determination of the mass-to-charge ratio" for reasons of simplicity.

Flight times are converted into mass via a calibration curve which can be stored in table form as a sequence of value pairs, flight times and masses, in the memory of the data processing system, or in the form of parameter values for a mathematical function of the mass relative to the time of flight.

For mass determination, the flight time t must be determined exactly to within fractions of a nanosecond. Since the mass signal is available as a line profile in time, the centroid of this line profile is normally used for exact determination of the flight time. The line profile is scanned according to current technology using a transient recorder with 1 or 2 gigahertz. Transient recorders with 4 gigahertz (and greater) are being developed. Generally, the measurements from several measuring cycles are cumulated before the centroid is created.

During formation of the vapor cloud, a small part of the molecules, both matrix and sample molecules, are ionized. During the quasi-explosive expansion of the vapor cloud, continuous ionization of the large molecules takes place through ion-molecule reactions at the cost of the smaller matrix ions. The large spread of velocities and the time-smeared formation process of the ions limit the mass resolution both of linear as well as energy-focusing reflector type time-of-flight mass spectrometers.

A method for improvement of mass resolution under these conditions has been known for some time. The ions of the cloud are first allowed to fly a brief time $\tau$ (usually in the range of 50 nanoseconds to 10 microseconds) in a drift region without any electrical acceleration. The faster ions thereby distance themselves further from the sample support electrode than the slow ions, and the distribution of the ion velocities results in a spatial distribution. Only then the acceleration of the ions in this region is switched on. The faster ions are then further away from the sample support electrode, and start their acceleration from a somewhat reduced accelerating potential. This gives them a somewhat lower final velocity inside the drift region of the time-of-flight spectrometer than the initially slower ions. With correct selection of the time lag $\tau$ and strength of the acceleration field, the initially slower, but after acceleration faster ions catch up again with the initially faster, but after acceleration slower ions exactly at the detector. In this way, ions are dispersed at the location of the detector relative to the mass, but if of equal mass, are focused in first order relative to the flight time. In this way, a moderately high mass resolution is achieved even in a linear time-of-flight mass spectrometer. There is a similar method for time-of-flight spectrometers with reflectors.

Delayed ion acceleration is usually not performed by switching the entire accelerating voltage U. Switching of such high voltages in extremely short times of a few nanoseconds is still almost unattainable today and associated with high costs. Switching of a partial accelerating voltage $U_1$ is sufficient if an intermediate electrode is installed in the acceleration path. Then only the space between the sample support electrode and the intermediate electrode, in a relatively small distance d from one another, need be field-free at first and then switched over after a delay into an acceleration field with a strength of $U_1/d$. The distance d of the sample support to the intermediate electrode should be as small as possible in order to switch the lowest possible voltage $U_1$. There is a lower limit for this distance, which is hardly realizable however for practical designs of ion sources. In practice, this distance d is about three millimeters.

An ion source for delayed ion acceleration therefore generally has at least one intermediate electrode between sample support and base electrode, the latter being at the potential of the field-free flight path. The ion source is therefore operated with at least two accelerating voltages, of which the first is applied between the sample support and the first intermediate electrode and the last between the last intermediate electrode and the base electrode. Normally, only one intermediate electrode is used, in which case there are then two accelerating voltages. In some cases, two intermediate electrodes are used. In principle however, it is also possible to accelerate the ions with one single (fully switchable) accelerating voltage and no intermediate electrode.

The method of delayed ion acceleration, however, also has its disadvantages. It provides the optimum mass resolution only in a narrow range of the mass scale. In the other parts of the total spectrum, the resolution is still considerably improved but not up to its optimum value. This range of optimum resolution may be adjusted to any desired position on the mass range by changing the time lag $\tau$ or by changing the partial accelerating voltage $U_1$, so that this disadvantage does not have too great an influence.

This does not apply to another, extremely decisive disadvantage for exact mass determination in the higher mass range: optimum mass resolution quickly decreases the higher the mass. For reasons of first order initial ion velocity focusing, the mass resolution is dependent on the velocity spread of the ions in front of the sample support. For an average length time-of-flight mass spectrometer (1.6 meters) and a velocity distribution between 200 and 1,300 meters per second, mass resolution is limited to maximum values of about $R_m$=40,000,000 amu/m, according to a rule of thumb derived from computer simulations. Here, departing from the standard definition, mass resolution is understood to be the flight time of ions divided by the complete line width at the foot of the line (measured in the same time units), and not by the usual width at half height. For ions of the mass m=1,000 amu, a resolution of about $R_m$=40,000 is thereby obtained which however drops for ions of the mass m=8,000 amu to $R_m$=5,000. This means that two ions of the masses $m_1$=8,000 amu and $m_2$=8,001 amu can no longer be separated from one another. Therefore, for higher masses, the known isotope patterns of organic ions certainly cannot be resolved in linear time-of-flight mass spectrometers of moderate size. In practice, the results obtained look even worse.

The poor mass resolution for ions of a higher mass also leads to a poorer signal-to-noise ratio, and therefore to poorer sensitivity and to poorer peak recognition.

Second order focusing relative to varying initial velocities has not been explicitly known for a linear mass spectrometer. However, in the publication "Space-Velocity Correlation Focusing" by S. M. Colby and J. P. Reilly, Anal. Chem. 1996, 68, 1419–1428, deviation curves in flight times for varying initial velocities are represented which suggest a second order focusing, without the authors describing it as such. These curves were calculated by simulation programs, although the basis of these programs has not been published in sufficient detail to be verified without further information. Since the calculations regard an unusually designed mass spectrometer with two extremely long acceleration regions before the relatively short flight tube and with two other post-accelerating regions after the field-free flight tube, it could be not be excluded that the combination of four acceleration regions, one of which with delayed ion acceleration, causes this type of focusing. The voltages were not dynamically altered after the acceleration has been switched on, with the exception of an experiment with finite rise time for the acceleration voltage, which however, according to the authors' statement, caused no substantial change in focusing.

OBJECT OF THE INVENTION

It is the objective of the invention to considerably improve the attainable mass resolution of linear time-of-flight mass spectrometers, especially in the higher mass range.

BRIEF DESCRIPTION OF THE INVENTION

It is the basic idea of the invention to compensate flight time deviations of ions of a single mass, which remain in spite of the application of delayed acceleration, by a dynamic variation of the accelerating field after switching on the acceleration, in such a way that a better mass resolution results, if possible, with focusing of second or higher order.

Figure 1:
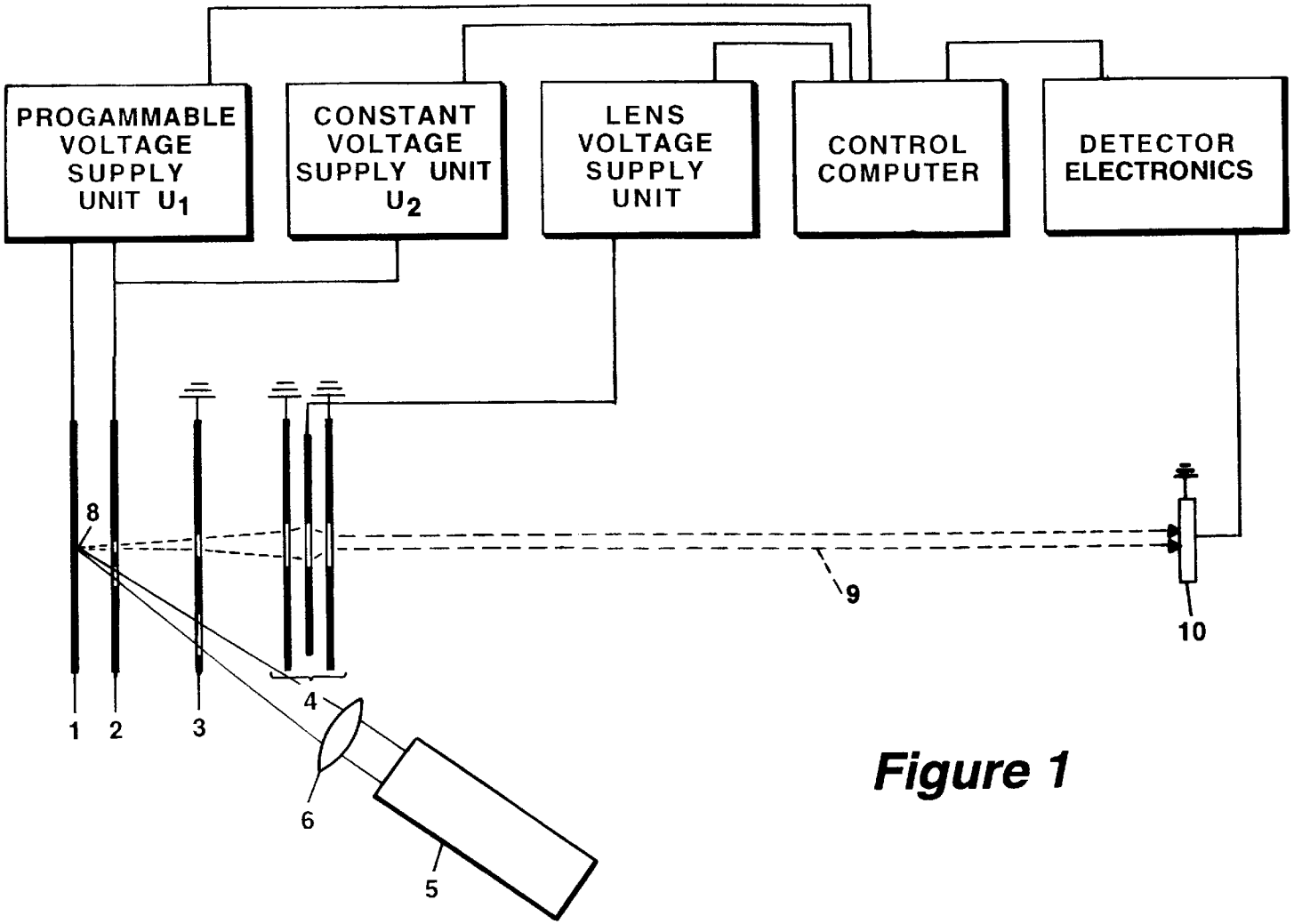
FIG. 1 shows the principle design of a time-of-flight mass spectrometer with its schematically indicated supply units. Its sample support electrode 1 is at the accelerating potential $U=U_1+U_2$, the intermediate electrode 2 is at the potential $U_2$, the base electrode 3 at ground potential. Here an ion-optical ion beam Einzel lens 4 is positioned in the field-free flight path between base electrode 3 and detector 10.

The accelerating voltage $U_1$ between sample support 1 and intermediate electrode 2 is switchable and dynamically changeable. A light flash from laser 5 is focused by lens 6 into a convergent light beam 7 onto sample 8, which is on sample support 1. At this time, the accelerating voltage has the value $U_1$=0. The light flash generates ions from the analysis substance in a MALDI process with an average initial velocity v≈700 meters per second and a large velocity spread. After a time lag $\tau$, the accelerating voltage $U_1$ is switched to the initial value $U_{1,0}$, whereupon it drops exponentially with a half-value time of $\theta_{1/2}$. As of time $t=\tau$, the ions are accelerated. They form beam 9 of the ion current which is measured by time resolution by detector 10 after passing through the field-free flight path between base electrode 3 and detector 10.

The arrangement shown here has gridless electrodes with round apertures as intermediate electrode 2 and base electrode 3 and therefore requires Einzel lens 4 for refocusing the ion beam 9. If grids are introduced into intermediate electrode 2 and base electrode 3, Einzel lens 4 is no longer required, however the intermediate grids reduce the achievable resolution due to their unavoidable small-angle spread.

Figure 2:
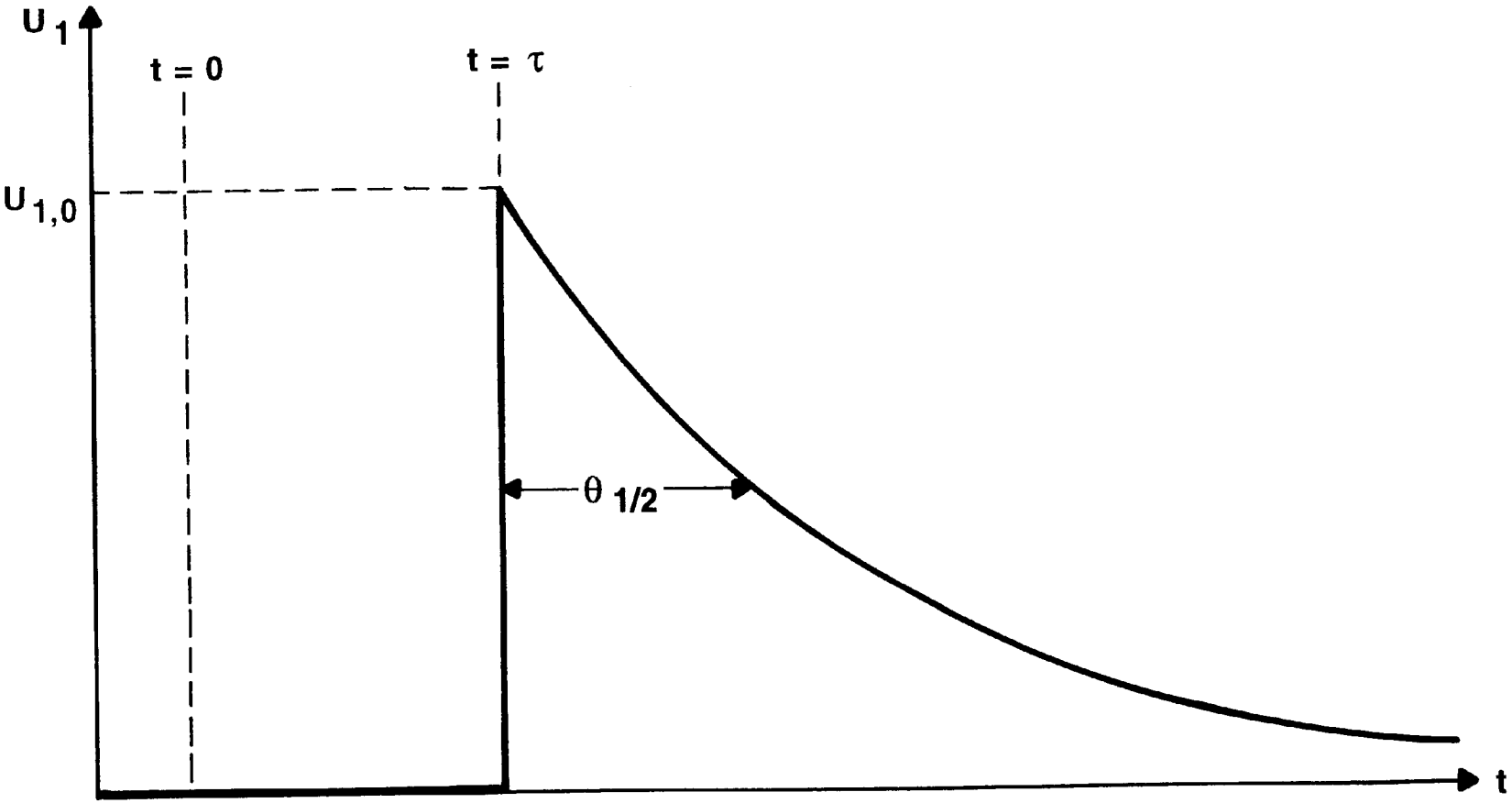

FIG. 2 shows a diagram of the dynamic variation of the accelerating voltage $U_1$. At the time t=0, the laser flash starts the ionization process. After a time lag $\tau$, the accelerating voltage $U_1$ is switched to the initial value $U_{1,0}$, whereupon it drops exponentially with a half-value time of $\theta_{1/2}$.

Figure 3:
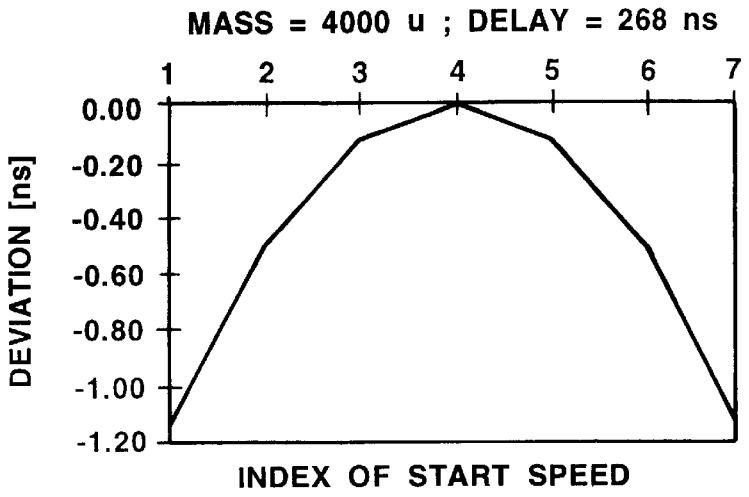
Figure 4:
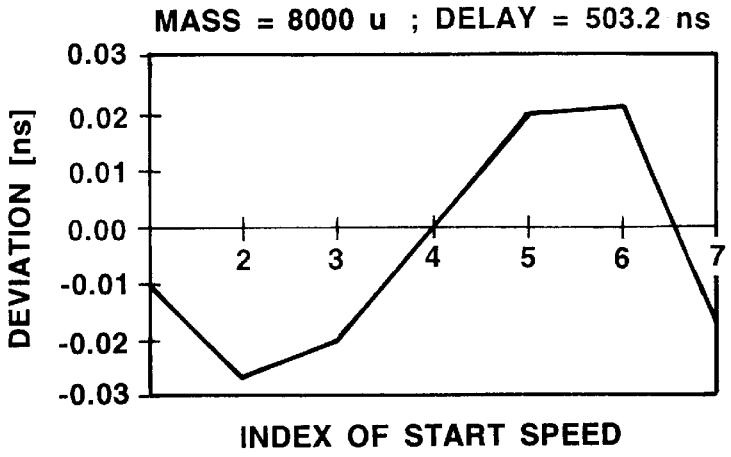
Figure 5:
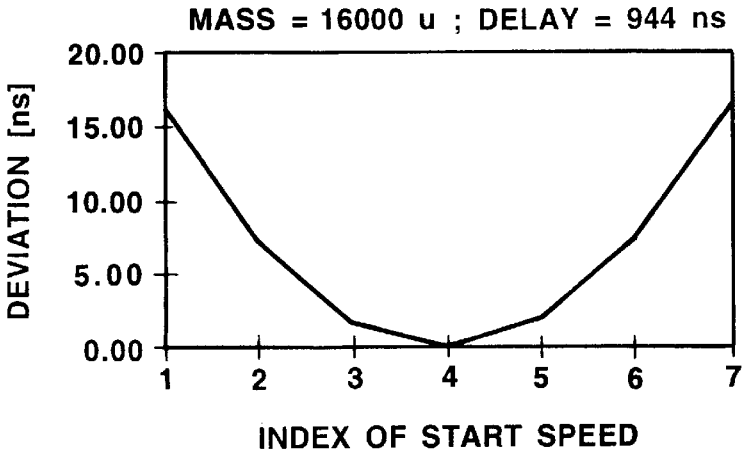

FIGS. 3, 4 and 5 show three diagrams of flight-time deviations of too fast and too slow ions compared to those of average velocity. Seven initial velocities were selected and labelled by the indexes 1 to 7. Index 1 corresponds to ions with an initial velocity of 250 meters per second, index 7 has a velocity of 1,150 meters per second. The average velocity (index 4) corresponds to 700 meters per second. The deviations in flight time are indicated in nanoseconds.

All diagrams were calculated for the same initial acceleration $U_{1,0}$=2.6 kilovolts and for the same exponential drop function, which in each case drops in one microsecond to 1/e=39.6% of the initial voltage. For the masses 4,000 amu, 8,000 amu and 16,000 amu, the focuses were adjusted by means of the selection of time delay $\tau$. In the case of FIGS. 3 and 5, the focuses are of first order, recognizable from the parabola-shaped curves of the deviations. In the case of FIG. 4, for the mass 8,000 amu, a second order focus point was obtained, recognizable from the third order parabola. In this case, the deviations are minimal, less than ±0.03 nanoseconds in total. With a total flight time of 62 microseconds, a flight time resolution of 1.3 million results from these deviations.

DETAILED DESCRIPTION OF THE INVENTION

The first order focusing of the initial velocities, achieved by delayed ion acceleration, shows a certain type of deviation in flight times of those ions whose initial velocity does not agree with the average velocity of the ions. This deviation is proportional to the square of the difference of initial velocities from an average initial velocity, therefore creating a parabola as can be seen in FIGS. 3 and 5. This parabola is typical for first order focusing. Both slower as well as faster ions therefore have somewhat shorter (or in other cases longer) flight times than the ions of average initial velocity. They therefore create a unilateral footing on the profile of the ion signal. This unilateral footing is not favorable for an exact determination of mass, since it generates a very asymmetrical form of the mass signal and hinders the exact determination of the signal center.

It is the basic idea of the invention to compensate for these deviations in the flight times by a dynamic change of the acceleration field after switching on the acceleration, in such a way that a second or higher order focusing results.

Computer simulations reveal that this goal can be achieved by different types of smooth, dynamic change functions, selectable at will, for the accelerating voltage creating the acceleration field in front of the sample support plate. Second order focusing for one mass can be achieved, for example, by a linear decrease of the acceleration voltage, by a hyperbolic decrease, or by an exponential decay function.

If there are more than one acceleration regions in the ion source, a dynamic variation of the first acceleration field works best, created by a dynamically alterated first accelerating voltage $U_1$=f(t) between the sample support plate and the first intermediate acceleration electrode. Dynamic variation of the accelerating voltage between the first intermediate electrode and the base electrode has less effect. But a dynamic change of several voltages at the same time can be used with some success, for example a change of the intermediate potential at the intermediate electrode with a constant total voltage, whereby both accelerating fields (and voltages) in front of and behind the intermediate electrode are changed at the same time.

The decrease of the acceleration may start directly after being switched on; i. e., after the delay time $\tau$. Interestingly, a small further delay $\tau_2$ (up to some 100 nanoseconds) before the start of the decrease has very little negative influence and can be easily compensated by small changes of other parameters.

With the correct selection of control parameters, all these changes result in second order focusing at the location of one ion mass in the spectrum. This location can be shifted, with slight limitations, to any required mass of the mass range by a change of the control parameters.

A most simple, linear time-of-flight mass spectrometer without post-accelerating region after the flight tube and with an ion source which has only one intermediate acceleration electrode, is defined by only three geometrical parameters: the distance $d_1$ between sample support and intermediate electrode, the distance $d_2$ between intermediate electrode and base electrode, and the length l of the field-free flight path up to the ion current detector. These parameters usually are firm; they cannot be changed without complicated mechanical effort once the mass spectrometer has been designed. If we now introduce a one-parametric dynamic function for the first accelerating voltage, the following four electric adjustment parameters exist:

1. The time lag $\tau$ for delayed ion acceleration in the region before the sample support, 2. the value of the second, unchanged accelerating voltage $U_2$, 3. the initial value $U_{1,0}$ for the first accelerating voltage switched on after delay $\tau$, and 4. the parameter for the dynamic change of the first accelerating voltage; for example the absolute voltage reduction per time unit in case of a linear decrease, or the relative voltage reduction per time unit for an exponential voltage decay after switching the voltage to its initial value (in the latter case, a decay constant $t_d$ or the time $\theta_{1/2}$ for a decrease to half the initial value can be used to characterize the voltage drop).

It turns out by computer simulations that, if two of these electrical adjustment parameters are fixed, the ion mass to be focused in second order can be shifted to any position in the mass spectrum by proper selection of the other two. The specification for both fixed parameters must however be located in a favorable value range, otherwise a lower mass threshold for the second order focus point exists.

If for example fixed values $U_{1,0}$ and $U_2$ for both accelerating voltages are selected, the focus point can thus be adjusted by means of time lag $\tau$ and the time constant $t_d$ of the dynamic voltage change. If on the other hand the unchanged second accelerating voltage $U_2$ and the time constant $t_d$ of the change of the first accelerating voltage are permanently set, the second order focus point can be set by means of time lag $\tau$ and initial value $U_{1,0}$ of the first voltage, provided that the time constant $t_d$ of the change provides a sufficiently fast alteration.

It should also be mentioned that a first order focus point can be obtained by a change of any single parameter. The shifting of this first order focus point requires the aid of a second adjustment parameter. This focus point is, in general, already sharper than the focus point without dynamic change of an accelerating voltage, thus offering a higher resolution.

Second order focus points with extremely high resolution can be obtained in computer simulations, although the optimum resolution again decreases as the masses become larger. However it is still possible to achieve unit resolution at 32,000 atomic mass units (resolution $R_m$=32,000 as defined above), i.e. the signal at 32,000 atomic mass units can still be completely separated from the signal at 32,001 atomic mass units. However, since the two flight times of these masses are only about 2 nanoseconds apart (at a total accelerating voltage of 30 kilovolts and with a flight tube length of 1.6 meter), the resolution can only barely be verified at the current state of the art of transient recorders and ion detectors.

A first example is given here for resolutions to be attained in simulation. The mass spectrometer is characterized by the following geometric defining quantities:

$d_1$=3 millimeters (distance between sample support and intermediate electrode), $d_2$=30 millimeters (distance between intermediate electrode and base electrode), l=1.6 meters (field-free flight path between base elect rode and detector).

The following adjustment parameters are also fixed:

$t_d$=1 microsecond (decay constant, exponential drop to 1/e), $U=U_{1,0}+U_2$=30 kilovolts (total accelerating voltage at $t=\tau$).

For this mass spectrometer, the following resolutions can be attained in computer simulations:

TABLE 1

Resolution $R_m$ at exponential drop with decay constant 1 μs

| Mass [amu] | Resolution $R_m$ | Time lag τ [ns] | $U_{1.0}$ [kV] | Order |
|---|---|---|---|---|
| 1,000 | 6,000,000 | 339 | 1.62 | 2nd |
| 2,000 | 2,000,000 | 364 | 2.00 | 2nd |
| 4,000 | 800,000 | 412 | 2.55 | 2nd |
| 8,000 | 290,000 | 473 | 3.40 | 2nd |
| 16,000 | 110,000 | 541 | 4.95 | 2nd |
| 32,000 | 44,000 | 605 | 7.53 | 2nd |

If on the other hand, the time constant of the exponential drop is increased to $t_d$=2 microseconds, second order focusing can no longer be attained for the lower masses:

TABLE 2

Resolution $R_m$ at exponential drop with decay constant 2 μs

| Mass [amu] | Resolution $R_m$ | Time lag τ [ns] | $U_{1.0}$ [kV] | Order |
|---|---|---|---|---|
| 1,000 | 92,000 | 396 | 1.33 | 1st |
| 2,000 | 160,000 | 616 | 1.38 | 1st |
| 4,000 | 170,000 | 614 | 1.67 | 1st |
| 8,000 | 410,000 | 686 | 2.05 | 2nd |
| 16,000 | 200,000 | 773 | 2.63 | 2nd |
| 32,000 | 105,000 | 885 | 3.55 | 2nd |

The mass resolution $R_m$ was calculated from the time resolution $R_t$. The time resolution here is the difference between the largest and the smallest flight time, divided by the flight time, calculated for ions of initial velocities between 250 and 1,150 meters per second. The mass resolution is, due to its quadratic dependence on the flight time, equal to half the time resolution. Since the time resolution takes the total line width, measured at the foot, into consideration, the mass resolution is also defined as total line width (contrary to convention).

The range of high resolution is quite narrow here. For a mass m=32,000 amu, at which a mass resolution of $R_m \approx 44,000$ was calculated in the first example, the range of unit resolution ($R_m \geqq 32,000$) only extends over about 40 atomic mass units, from approx. 31,980 to 32,020 amu. In the second example ($R_m \approx 105,000$), the range of unit resolution extends over 100 mass units from 31,955 amu to 32,055 amu.

However, the high resolutions are purely computational values which cannot be achieved in reality, since the MALDI process, field errors and particularly the detectors available today limit the signal widths to the narrowest lines of 2 nanoseconds at best. For this reason, the following values, at best, can be obtained in time-of-flight mass spectrometers with 30 kilovolts total acceleration and 1.6 meters length:

TABLE 3

Practically attainable maximum resolutions

| Mass [amu] | Maximum time resolution $R_t$ | Maximum mass resolution $R_m$ |
|---|---|---|
| 1,000 u | 10,000 | 5,000 |
| 2,000 u | 15,000 | 7,500 |
| 4,000 u | 21,000 | 10,500 |
| 8,000 u | 30,000 | 15,000 |
| 16,000 u | 43,000 | 21,500 |
| 32,000 u | 60,000 | 30,000 |

All computed values above these can therefore not yet be verified in experiments. However it is possible, with the method and instrument according to this invention, to obtain the values given here. It can also be expected that new generations of detectors will allow improved resolution.

In contrast to normal "delayed constant ion acceleration", which offers first order focusing only, not only one but two parameters must always be set optimally in the case of the "delayed dynamic ion acceleration" presented here, in order to obtain second order focusing. In practice, the optimum parameters have to be found by a calibration procedure, as any specialist in the field knows.

A third example is given here for resolutions achieved in simulation, this time for a linear drop in the accelerating voltage $U_1$. The mass spectrometer here is characterized by the following geometric parameters:

$d_1$=3 millimeters (distance between sample support and intermediate electrode), $d_2$=12 millimeters (distance between intermediate electrode and base electrode), l=1.6 meters (field-free flight path between base electrode and detector).

The following adjustment parameters are fixed this time:

$t_a$=2 μs (time for full linear drop of $U_1$ to zero)

$U_2$=30 kilovolts (second accelerating voltage).

The following resolutions can be achieved in computer simulations for this mass spectrometer:

TABLE 4

Resolution at full linear drop in 2 μs

| Mass [amu] | Resolution $R_m$ | Time lag τ [ns] | $U_{1.0}$ [kV] | Order |
|---|---|---|---|---|
| 1,000 | 178,000 | 475 | 1.28 | 1st |
| 2,000 | 1,600,000 | 465 | 1.55 | 1st |
| 4,000 | 7,750,000 | 461 | 1.98 | 2nd |
| 8,000 | 840,000 | 481 | 2.67 | 2nd |
| 16,000 | 220,000 | 505 | 3.91 | 2nd |
| 32,000 | 70,000 | 526 | 6.36 | 2nd |

If a full linear drop in only one microsecond is selected, second order focus points can be found again for all above given masses, with resolutions above 30 million for the masses 1,000 and 2,000 amu. The drop of the resolution as mass increases is somewhat larger here, as was also apparent for the first two examples.

The second and third examples show that there is a mass threshold for the occurrence of second order focusing which is dependent on the time constant of the voltage change. Between the mass range which only allows a first order focusing and the range above with second order focusing, there is additionally always a mass which can be focused in third order. Here extreme resolutions can be obtained. This point can also be shifted to any desired position in the spectrum by changing three adjustment parameters.

From the known mass-dependent change of both adjustment parametersfor optimum resolution, obtained by a calibration procedure, a control system can be constructed according to this invention by which the optimum resolution can be shifted to any position in the mass spectrum. In this way a mass spectrometer can be built with which the optimum resolution can be set at a wanted position in the spectrum at which a special signal is expected.

For most analytical tasks in industry, medicine and research, a certain expected value exists for the mass of the ions to be determined. Only a few areas of application are mentioned here briefly: production control, quality assurance, medical protein analyses, DNA mutant analyses, markings with stable isotopes. However, there are always tasks which arise for which it is important to oversee a larger mass range at the same time. For such tasks, the mass spectrometer must be adjusted, as a compromise, with some arbitrary defocusing to find the mass peaks.

The invention has particular advantages other than that of high resolution. In the second order focus point, the profiles of the mass signals of interest are symmetrical, so that the position of the mass signal can be determined much more correctly through the method of centroid formation than in the first order focus point with its asymmetrical form. Additionally, the position of the mass signal is much more independent of the average velocity of the ions. If the average velocity of the ions in the resulting vapor cloud is changed by incidental variation of the laser light intensity (or by other influences), a much smaller shift of the mass signal position results in the second order focus point than in the first order focus point. The method is much more resistant to incidental or intentional interventions.

Particularly Favorable Embodiments

A design for a linear time-of-flight mass spectrometer with high resolution according to this invention is shown in principle in FIG. 1.

When using the delayed dynamic ion acceleration according to this invention, sample support 1 and intermediate electrode 2 are first at potential $U_2$. The sample support is switched up to the potential $U_{1,0}+U_2$ after the time lag $\tau$ of several ten to thousand nanoseconds after the ionizing laser flash. An immediate (or somewhat delayed with a time $\tau_2$) exponential drop in the accelerating voltage $U_1=U_{1,0}\times f(t)=U_1\times e^{-t/t0}$ occurs, so that the sample support is once again at the potential $U_2$ after some time. The temporal change of the accelerating voltage $U_1$ is represented in the diagram in FIG. 2.

By correct selection of the time lag $\tau$, the voltages $U_1$ and $U_2$ and the half-value time $\theta_{1/2}$ (or the time constant $t_0$ of the exponential drop, high resolution through second order focusing is attained at one distinct ion mass in the spectrum. The ion mass of best resolution can be adjusted. For optimum performance in spite of easy operation, two of the four adjustment parameters can even be permanently set; two of the adjustment parameters suffice for the achievement of high resolution with second order focusing at any mass.

Operation with dynamic variation of one parameter alone, e. g. the control of $U_1$, to achieve high resolution at one ion mass, is one of many possible variants. Thus, for example, also the accelerating voltage $U_2$ can either be dynamically variied alone (with mocerate success) or in conjunction with a control of $U_1$. For example, the total voltage $U=U_1+U_2$ can be kept constant, but both voltages $U_1+U_2$ are dynamically changed in opposite directions. The dynamic variations also need not be exponential. Every combination of parameter control decribed above is applicable with linear dynamic variations of parameters. Similar values for high resolution can be achieved with this linear changes; the linear change however has the disadvantage that it must actively be ended, thus complicating the design of the electronics. Also various other functions, for example a hyperbolic drop $1—1/(t—t_0)$, can be used.

The dynamic variation by an exponential decay function change has the advantage that it (a) can be generated very easily by electric means, for example by a capacitor discharged by a resistor, and that it (b) comes to a natural end that need not be actively initiated.

With this arrangement for a time-of-flight mass spectrometer, spectra of analyte substances can be obtained as usual. Spectrum acquisition begins with ionization of the analyte substances 8 on the sample support 1, as in the MALDI method of ionization described here. The ions are generated by a light flash of about 3 to 5 nanoseconds duration from laser 5. Usually, UV light with a wavelength of 337 nanometers is used from a moderately priced nitrogen laser, but any other applicable laser wavelength may be used. The light flash is focused through lens 6 as convergent light beam 7 onto the sample 8 on the surface of the sample support 1. The ions formed in the vapor cloud, which is generated by the laser focus, are electrically accelerated after the time lag $\tau$, first in the electrical field between sample support 1 and intermediate electrode 2, however with dynamically decreasing strength according to this invention, and then in the electrical field between intermediate electrode 2 and base electrode 3. The ion beam, slightly defocused in the gridless electrode arrangement, is refocused at the beginning of the flight path in an Einzel lens 4 onto detector 10. The flying ions form a strongly variable ion current 9, which is measured at the end of the flight path by ion detector 10 with high time resolution.

Through the special MALDI process, mass signals can be generated at the detector which have a temporal width of far less than one nanosecond, even though the light flash of the laser has a temporal length of 3 to 5 nanoseconds.

The time-variable ion current provided by the ion beam is usually measured and digitized at the detector with a scanning rate of 1 or 2 gigahertz. Transient recorders at an even higher temporal resolution will soon be available. Usually, the concurrently measured values from several scans are cumulated before the mass signals in the stored data are sought by peak recognition methods, and transformed from the time scale into mass values via the mass calibration curve.

The polarity of the high voltage used for the ion acceleration must be the same as the polarity of the ions being analyzed: positive ions are repelled and accelerated by a positively charged sample support, negative ions by a negatively charged sample support. Of course, the time-of-flight mass spectrometer can also be operated in such a way that the flight path is in a tube (not shown in FIG. 1), which is held at potential U, while the sample support 1 is at ground potential. In this special case, the flight tube is at a positive potential if negatively charged ions are to be analyzed, and vice versa. This operation simplifies the design of the ion source, since the isolators for the holder of the exchangeable sample support 1 are no longer necessary. In this case it is favorable to switch and vary the potential of the intermediate electrode.

The focus range can be shifted as desired by control of two adjustment parameters, for example by the time lag $\tau$ and the initial accelerating voltage $U_{1,0}$. Any specialist in the field can design a corresponding calibration procedure.

It is even possible to perform the shift in such a way that the calibrated mass scale remains valid. To do this, the accelerating voltage $U_2$ must also be changed in an appropriate manner. If this type of displacement of the focus range is calibrated and then permanently installed in the computer control of the mass spectrometer (and no other control of the adjustment is permitted), this displacement of the focus range will not harm any subsequent mass determination, since the mass scale remains valid under these conditions.

I claim:

1. Method for the acquisition of highly time-resolved mass spectra of analyte ions in a linear time-of-flight mass spectrometer with a single field-free flight path, with analyte substances applied to the surface of a sample support plate, and with one or more acceleration regions between sample support plate and the field-free flight path, comprising the steps of (a) ionizing molecules of the analyte by a pulse of an ionizing beam, (b) waiting for a delay time $\tau$, (c) switching on an electric acceleration field in front of the sample support, thereby starting the electric acceleration of the ions, (d) dynamically and linearly decreasing the electric acceleration field in front of the sample support to achieve good time focusing for ions of one mass at the end of the flight path, (e) if more then one acceleration regions are present, accelerating the ions in the further acceleration regions, and (f) measuring the highly time resolved ion current at the end of the flight path of the mass spectrometer.

2. Method according to claim 1, wherein the delay time $\tau$ amounts to a value between 10 and 10,000 nanoseconds.

3. Method according to claim 1, wherein the dynamic decrease of the acceleration field is delayed by a second delay time $\tau_2$ relative to the start of the acceleration process.

4. Method according to claim 1, wherein the accelerating voltage used to generate the electric acceleration field is dynamically decreased by a smooth function of time.

5. Method according to claim 1, wherein the decrease to zero voltage takes place in 0.1 to 10 microseconds.

6. Method according to claim 4, wherein the accelerating voltage is decreased by an exponential decay function.

7. Method according to claim 6, wherein the decay constant is within the range of 0.1 to 10 microseconds.

8. Method according to claim 1, wherein the total accelerating voltage between sample support and field-free flight path of the time-of-flight mass spectrometer remains constant and only the potential of a first intermediate acceleration electrode is dynamically increased to decrease the potential difference between sample and support intermediate electrode.

9. Linear time-of-flight mass spectrometer comprising (a) a sample support plate carrying analyte samples at its surface, (b) at least one intermediate acceleration electrode, (c) a base electrode at the potential of the field-free flight path, (d) an ionizer for pulsed ionization of the analyte samples on the sample support plate, (e) voltage supplies for the potentials of the sample support electrode and intermediate electrodes, whereby the voltage supplies for the sample support and the first intermediate electrode deliver voltages which can be switched from equal potentials to differing potentials after a time delay $\tau$ with respect to the ionizing pulse, and whereby the voltage difference between the sample support and intermediate electrode decreases dynamically and linearly after being switched to differing potentials.

10. Method for the acquisition of highly time-resolved mass spectra of analyte ions in a linear time-of-flight mass spectrometer with a single field-free flight path, with analyte substances applied to the surface of a sample support plate, and with one or more acceleration regions between sample support plate and the field-free flight path, comprising the steps of (a) ionizing molecules of the analyte by a pulse of an ionizing beam, (b) waiting for a delay time $\tau$, (c) switching on an electric acceleration field in front of the sample support, thereby starting the electric acceleration of the ions, (d) after a second delay time $\tau_2$, dynamically decreasing the electric acceleration field in front of the sample support to achieve good time focusing for ions of one mass at the end of the flight path, (e) if more then one acceleration regions are present, accelerating the ions in the further acceleration regions, and (f) measuring the highly time resolved ion current at the end of the flight path of the mass spectrometer.

11. Method according to claim 10, wherein the accelerating voltage used to generate the electric acceleration field is dynamically decreased by a smooth function of time.

12. Method according to claim 10, wherein the accelerating voltage is decreased by an exponential decay function.

13. Method according to claim 12, wherein the decay constant is within the range of 0.1 to 10 microseconds.

14. Method according to claim 10, wherein the total accelerating voltage between sample support and field-free flight path of the time-of-flight mass spectrometer remains constant and only the potential of a first intermediate acceleration electrode is dynamically increased to decrease the potential difference between sample support and intermediate electrode.

15. Linear time-of-flight mass spectrometer comprising (a) a sample support plate carrying analyte samples at its surface, (b) at least one intermediate acceleration electrode, (c) a base electrode at the potential of the field-free flight path, (d) an ionizer for pulsed ionization of the analyte samples on the sample support plate, (e) voltage supplies for the potentials of the sample support electrode and intermediate electrodes, whereby the voltage supplies for the sample support and the first intermediate electrode deliver voltages which can be switched from equal potentials to differing potentials after a time delay $\tau$ with respect to the ionizing pulse, and whereby the voltage difference between the sample support and intermediate electrode decreases dynamically after the switching to differing potentials and a delay time period $\tau_2$ subsequent thereto.

16. Device as in claim 15, wherein the dynamically decreasing potential difference decreases exponentially with time.

* * * * *